US006364700B1

(12) United States Patent
Zhu et al.

(10) Patent No.: US 6,364,700 B1
(45) Date of Patent: Apr. 2, 2002

(54) ELECTRICAL CONNECTOR ASSEMBLY

(75) Inventors: ZiQiang Zhu; ZhongHua Yao; ZhiQuan Mou, all of KunSan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/690,105

(22) Filed: Oct. 16, 2000

(30) Foreign Application Priority Data

Jun. 3, 2000 (TW) ..... 089209517 U

(51) Int. Cl.[7] ..... H01R 13/73
(52) U.S. Cl. ..... 439/567; 439/607
(58) Field of Search ..... 439/567, 571, 439/572, 607–610

(56) References Cited

U.S. PATENT DOCUMENTS 5,664,965 A * 9/1997 Clark et al. ..... 439/567
6,036,544 A * 3/2000 Brunker et al. ..... 439/607
6,083,043 A * 7/2000 Lok ..... 439/567
6,095,861 A * 8/2000 Lin et al. ..... 439/607
6,109,968 A * 8/2000 Wang ..... 439/567
6,155,872 A * 12/2000 Wu ..... 439/607
6,168,463 B1 * 1/2001 Wu ..... 439/567

* cited by examiner

*Primary Examiner*—Gary F. Paumen
(74) *Attorney, Agent, or Firm*—Wei Te Chung

(57) ABSTRACT

An electrical connector assembly (1) includes an insulative housing (10) defining a plurality of terminal receiving channels (118, 123) therein. A plurality of terminals (30, 31) is respectively secured within the terminal receiving channels of the insulative housing. A shield (20) generally encloses the insulative housing. A locking device (220) is formed on each of two opposite side faces of the shield, each locking device including a pair of first locking legs (27) and a pair of second locking legs (28). The first locking legs and the second locking legs are arranged in opposite sequence on the two opposite side faces of the shield. The first locking legs and the second locking legs each form a protrusion (227 or 228) projecting outwardly, each protrusion of the first legs being spaced a first distance below a lower side face of the shield and each protrusion of the second legs being spaced a second distance below the lower side face of the shield, the second distance being larger than the first distance.

1 Claim, 5 Drawing Sheets

ELECTRICAL CONNECTOR ASSEMBLY

FIELD OF THE INVENTION

The present invention relates to an electrical connector assembly, and particularly to an electrical connector assembly having a locking device for securing the electrical connector assembly to printed circuit boards having different thicknesses.

BACKGROUND OF THE INVENTION

Taiwan Patent Application Nos. 85212192 and 86207969 each disclose an electrical connector having a locking device for securing the electrical connector to a printed circuit board. Referring to FIG. 6, a locking device of the electrical connector has a pair of locking legs 62 which are adapted for engaging with corresponding holes 72 defined in the printed circuit board 7. The locking device is not suitable for locking the electrical connector to printed circuit boards with different thicknesses. Thus, its versatility is limited.

To solve the above problem, U.S. Pat. No. 5,664,965 discloses an electrical connector assembly having a locking device 8 for securing the electrical connector to printed circuit boards 9 and 9' having different thicknesses (FIG. 7). However, a bottom face of a left side of the printed circuit board 9 is not engaged by the protrusion 86. This results in an insecure connection between the electrical connector assembly and the printed circuit board 9. A similar problem exists when the locking device 8 engages with another printed circuit board 9' having a larger thickness.

Hence, an improved locking device for an electrical connector assembly is required to overcome the disadvantages of the prior art.

BRIEF SUMMARY OF THE INVENTION

An object of the present invention is to provide an electrical connector having a locking device for securing the electrical connector to at least two printed circuit boards having different thicknesses.

To fulfill the above-mentioned objective, an electrical connector assembly in accordance with the present invention comprises an insulative housing defining a plurality of terminal receiving channels therein. A plurality of terminals is respectively secured within the terminal receiving channels of the insulative housing. A shield generally encloses the insulative housing. A locking device is formed on each of two opposite side faces of the shield. Each locking device comprises a pair of first locking legs and a pair of second locking legs. The first locking legs and the second locking legs are arranged in opposite sequence on the two opposite side faces of the shield. The first locking legs and the second locking legs each form an outwardly directed protrusion, wherein each protrusion of the first legs is spaced a first distance below a lower side face of the shield and each protrusion of the second legs is spaced a second distance below the lower side face of the shield, the second distance being larger than the first distance.

Other objects, advantages and novel features of the invention will become more apparent from the following detailed description of the present embodiment when taken in conjunction with the accompanying drawings.

DETAILED DESCRIPTION OF THE INVENTION

Figure 1:
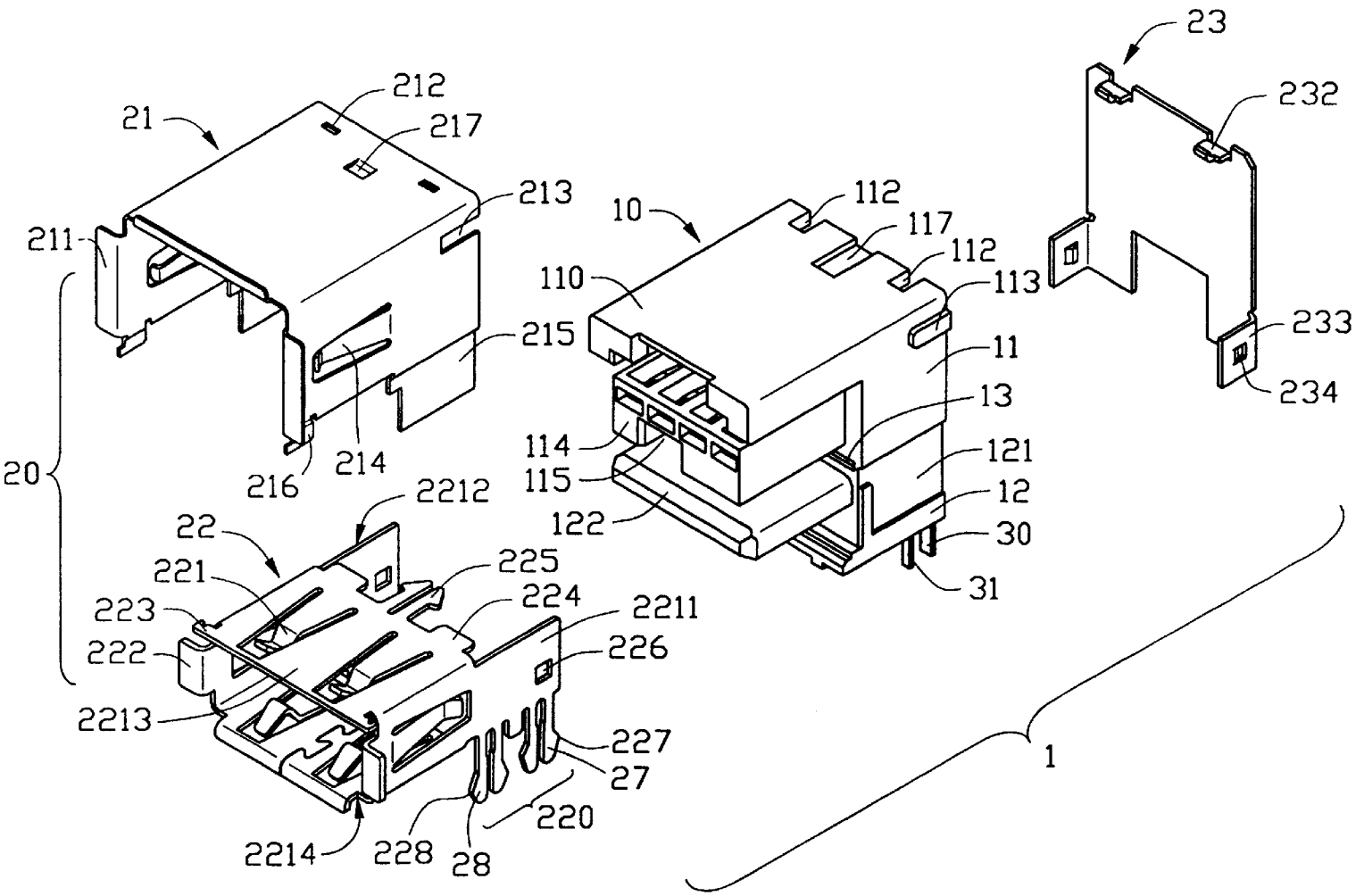
FIG. 1 is an exploded view of an electrical connector assembly of the present invention.
Figure 2:
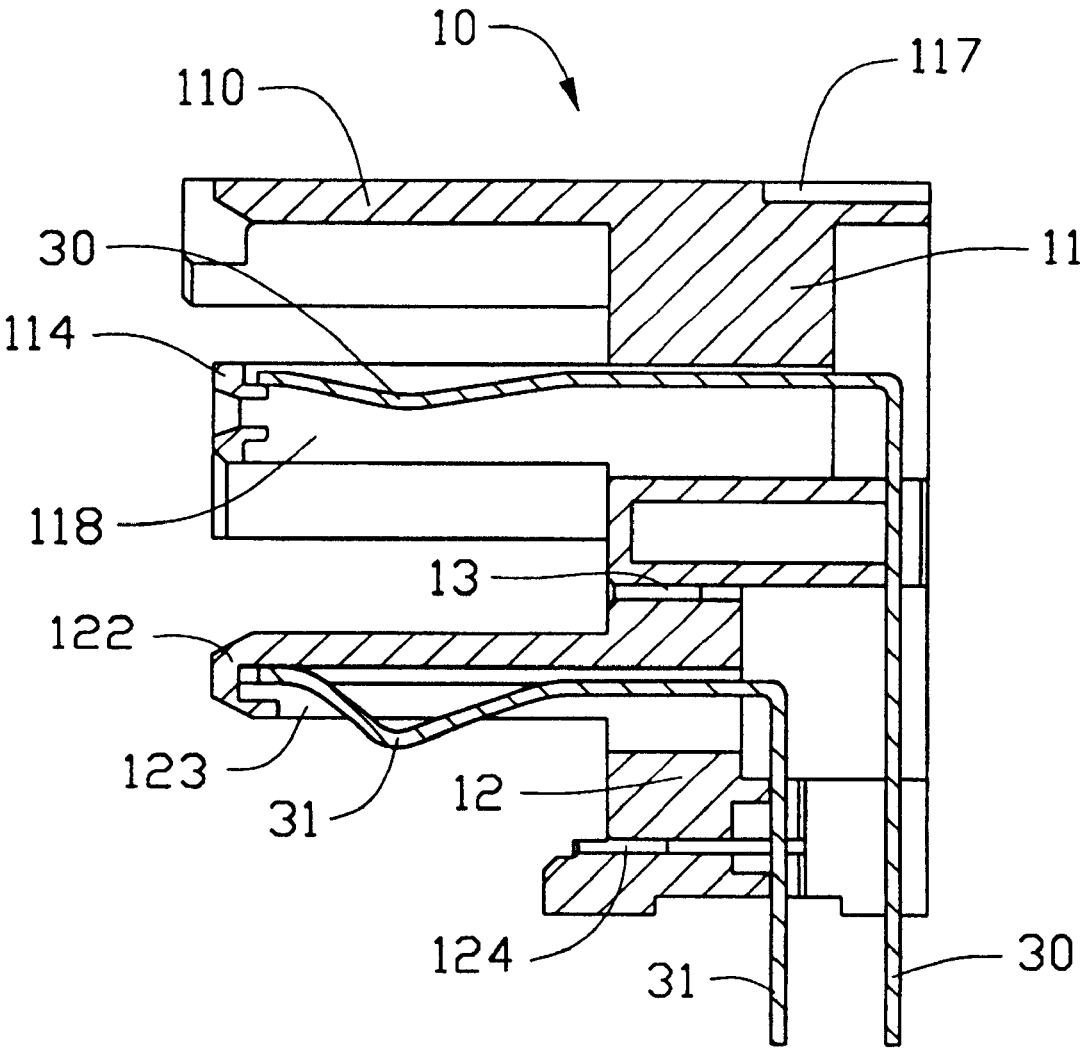
FIG. 2 is a cross-sectional view of the assembled electrical connector with a shield thereof removed.

Referring to FIGS. 1 and 2, an electrical connector assembly 1 comprises an insulative housing 10, a shield 20 and a plurality of terminals 30 and 31. The insulative housing 10 comprises an upper body 11 having a flat portion 110 and a lower body 12. A plurality of spacing slots 13 are defined between the upper body 11 and lower body 12. The upper body 11 defines two channels 112 and a groove 117 on a rear end thereof. The upper body 11 further comprises a protrusion 113 projecting from each of two opposite side faces (not labeled) thereof. A first socket 114 and a second socket 122 respectively extend from corresponding front faces (not labeled) of the upper body 11 and the lower body 12. The first socket 114 defines a recess 115 on a front portion thereof for avoiding a misorientation of the connector assembly 1 with a mating complementary connector. The first socket 114 further defines a plurality of terminal receiving channels 118 for receiving corresponding terminals 30 therein. The second socket 122 defines plural terminal passageways 123 for retaining corresponding terminals 31 therein. The lower body 12 further defines a hole 124 in a lower portion thereof.

The shield 20 comprises a first part 21 for shielding the upper body 11, a second part 22 for shielding the lower body 12, and a third part 23 for shielding a rear portion (not labeled) of the insulative housing 10. These three parts 21, 22 and 23 are secured together onto the housing 10.

The first part 21 has a top face (not labeled) and two side faces (not labeled) connected to the top face thereof. Each side face forms a leading plate 211 on a front portion thereof. The top face defines two securing holes 212 and forms a tab 217 corresponding to the channels 112 and the groove 117 of the housing 10, respectively. Each side face defines a recess 213 corresponding to the projection 113, and a resilient arm 214 extending inwardly. Each side face further forms a plate 215 at a lower edge thereof corresponding to a concave face 121 of the lower body 12, and a finger 216 on a front portion below the leading plate 211.

The second part 22 comprises four side faces (2211, 2212, 2213, 2214) forming a hollow space (not labeled) therebetween. Each side face 2211, 2212, 2213, 2214 forms at least a tab 221 projecting inward into the hollow space. All side faces except for the upper side face 2213 each form a leading plate 222 extending forward and outward from a forward edge thereof. The upper side face 2213 forms an ear 223 on each of two opposite ends of a front edge thereof corresponding to the finger 216 of the first part 21. The upper side face 2213 further forms two protruding plates 224 and a latch 225 both extending rearwardly and corresponding to the spacing slots 13 of the insulative housing 10. The lower side face 2214 also forms a latch (not shown) having a structure similar to the latch 225, located on a rear edge thereof and corresponding to the hole 124 of the lower body 12. In addition, the right side face 2211 and the left side face 2212 each define a rectangular hole 226 on a rear end thereof and a locking device 220 on a lower edge thereof.

Each locking device 220 comprises a pair of first locking legs 27 and a pair of second locking legs 28. The first locking legs 27 and the second locking legs 28 are arranged in opposite sequence on the right side face 2211 and on the left side face 2212. The first locking legs 27 on the right side face 2211 (FIG. 4) are located to a rear of the second locking legs 28, while on the left side face 2212, the first locking legs 27 are located to a front of the second locking legs 28 (best seen in FIG. 5).

The first locking legs 27 are formed in mirror-image pairs, each forming an oppositely directed protrusion 227 projecting outward near a lower end thereof. The two protrusions 227 of the first locking legs 27 are spaced a first distance d1 (see FIG. 4) below the lower side face 2214. The first locking legs 27 are sized for securing the electrical connector assembly 1 to the thinner printed circuit board 4.

The second locking legs 28 are also formed in mirror-image pairs, each forming an oppositely directed protrusion 228 projecting outward near a lower end thereof. The two protrusions 228 of the second locking legs 28 are spaced a second distance d2 (see FIG. 4) below the lower side face 2214. The second distance d2 is greater than the first distance d1. The second locking legs 28 are sized for securing the electrical connector assembly 1 to the thicker printed circuit board 5. The protrusions 228 are positioned lower than the protrusions 227 when the electrical connector assembly 1 sits upright.

The third part 23 of the shield 20 forms two clips 232 forwardly extending from an upper edge thereof, corresponding to the securing holes 212 of the first part 21. A pair of vertical plates 233 forwardly extend from two side edges of the third part 23. Each vertical plate 233 forms a resilient tab 234 corresponding to the rectangular hole 226 of the second part 22.

Figure 3:
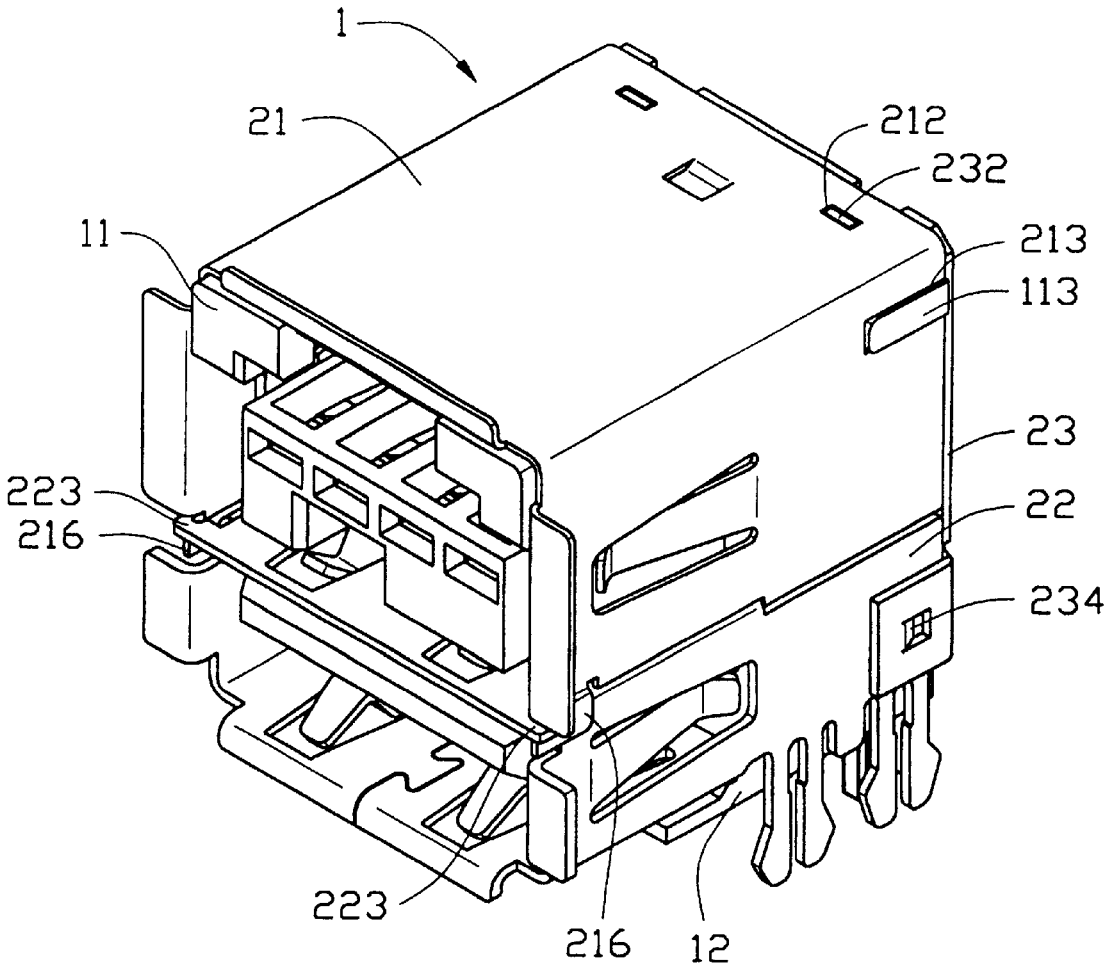
FIG. 3 is an assembled view of FIG. 1.
Figure 4:
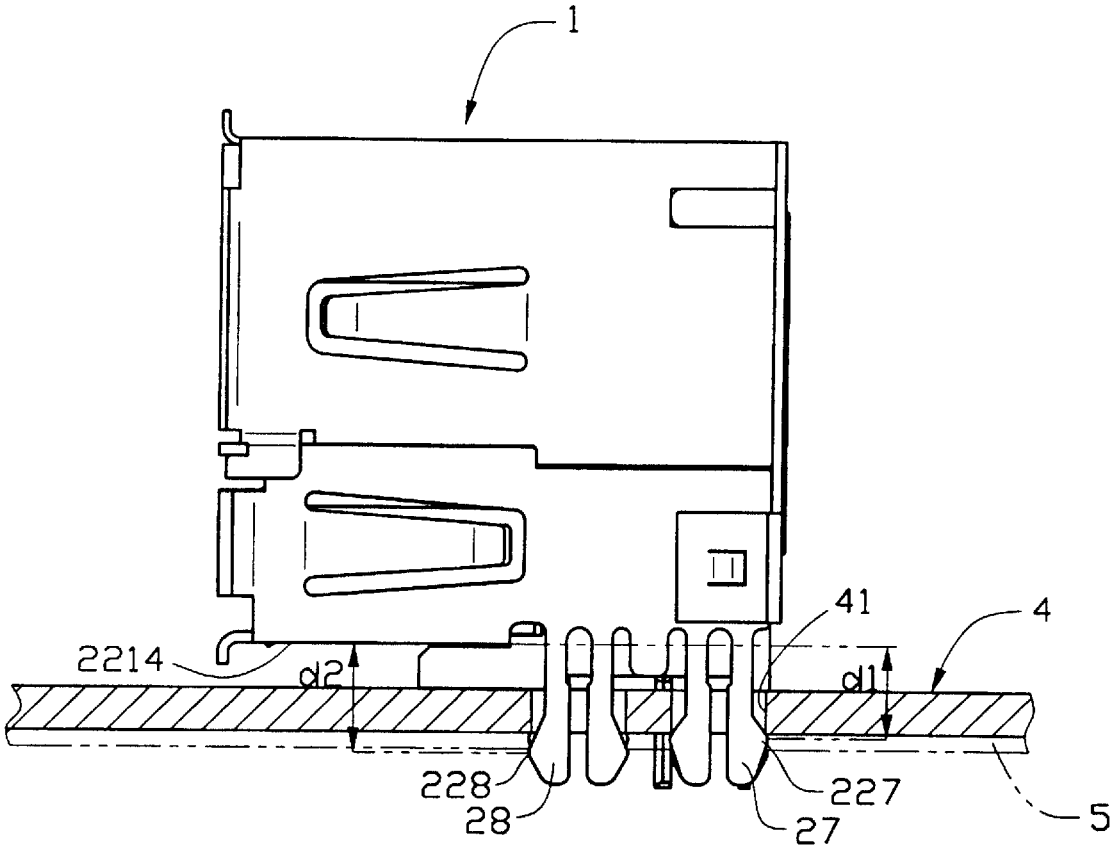
FIG. 4 is a side view of the assembled electrical connector and two printed circuit boards having different thicknesses.

Referring to FIGS. 3 and 4, in assembly, the first part 21 is assembled to the upper body 11 to enclose the upper body 11, with the recesses 213 and the tab 217 respectively engaging with the protrusions 113 and the groove 117. The rectangular plates 215 respectively extend into the concave faces 121 of the housing 10. The second part 22 is assembled to the housing 10 to enclose the lower body 12 with the latch 225 and the protruding plates 224 respectively extending into the spacing slots 13 of the insulative housing 10 and engaging therewith. The latch (not shown) on the lower side face 2214 extends into the hole 124 of the lower body 12 and the ears 223 engage with the fingers 216 of the first part 21. The third part 23 is assembled to the housing 10 from a rear face of the housing 10 and covers a rear portion thereof, wherein the clips 232 mate with the securing holes 212 of the first part 21 and the resilient tabs 234 engage with the rectangular holes 226 of the second part 22.

Figure 5:
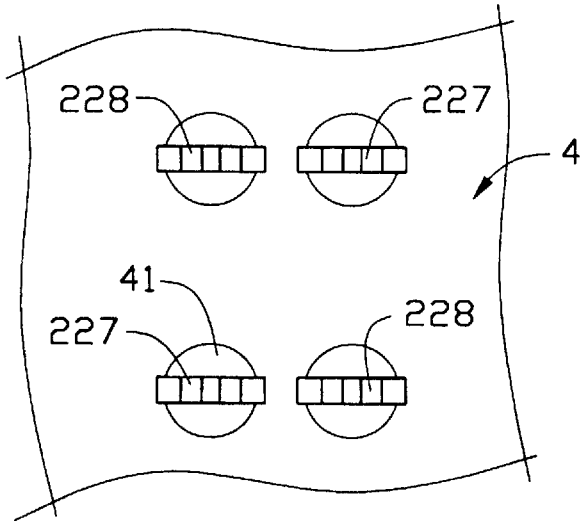
FIG. 5 is a bottom view of FIG. 4.
Figure 6:
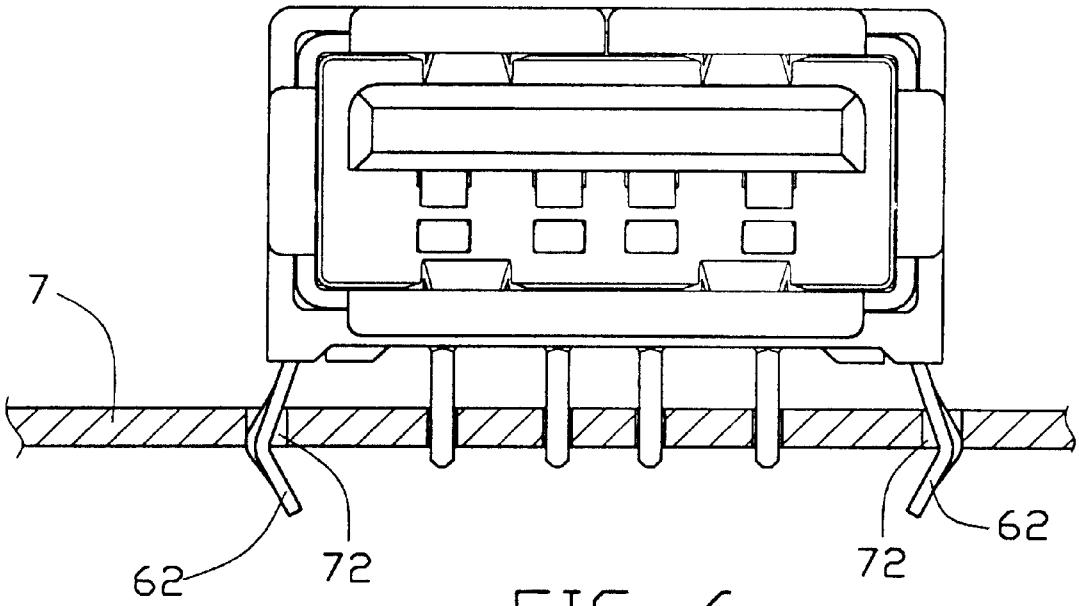
FIG. 6 (PRIOR ART)
FIG. 6 is a front view of a prior art electrical connector assembled to a printed circuit board.
Figure 7:
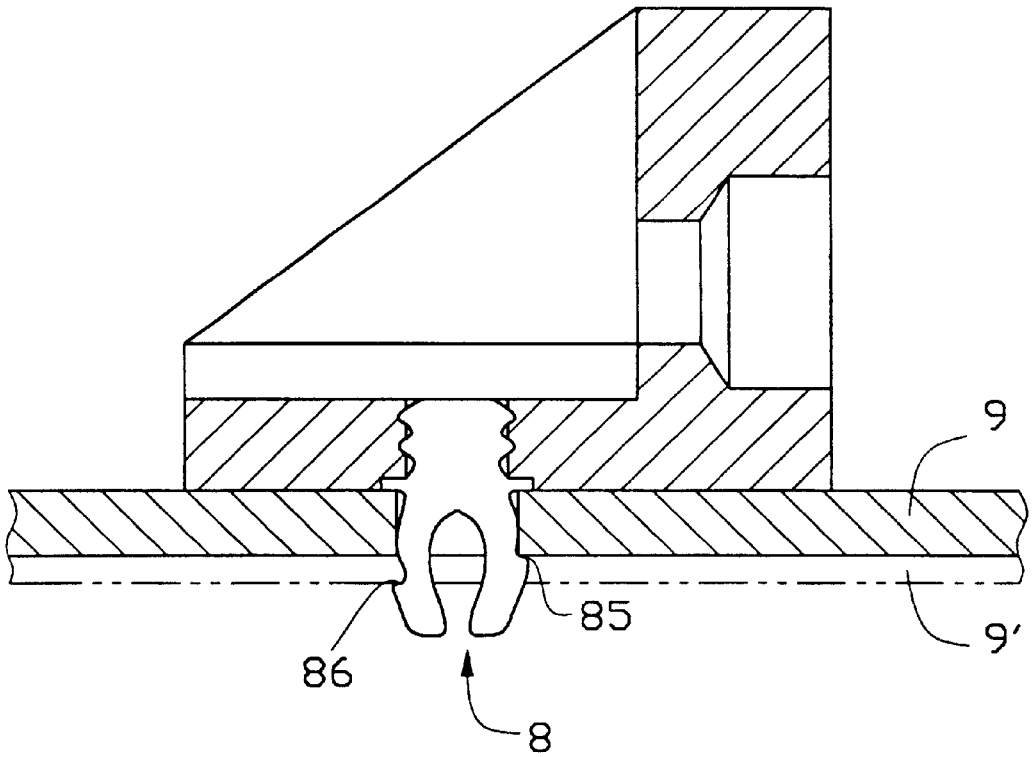
FIG. 7 (PRIOR ART)
FIG. 7 is a cross-sectional view of another prior art connector assembled to a printed circuit board.

Referring to FIGS. 4 and 5, the electrical connector assembly 1 is secured to the printed circuit board 4 with the first locking legs 27 engaging with through holes 41 therein. The first locking legs 27 securely lock left and right sides of the connector assembly 1 to the circuit board 4. If the locking device 220 of the present invention is required to secure the electrical connector assembly 1 to the thicker printed circuit board 5 (a lower surface of which is shown as the broken line in FIG. 4), the second pair of locking legs 28 are used to firmly secure the connector assembly to the printed circuit board 5 in a manner similar to that by which the protrusions 227 secure the connector assembly 1 to the printed circuit board 4.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector assembly adapted for being secured to a printed circuit board and for mating with a mating connector, comprising:

an insulative housing defining a plurality of terminal receiving channels therein;

a plurality of terminals respectively secured within the terminal receiving channels of the insulative housing;

a shield generally enclosing the insulative housing; and a locking device formed on each of two opposite side faces of the shield, each locking device comprising a pair of first locking legs and a pair of second locking legs, the first locking legs and the second locking legs being arranged in opposite sequence on the two opposite side faces of the shield, the first locking legs and the second locking legs each forming a protrusion projecting outwardly, each protrusion of the first legs being spaced a first distance below a lower side face of the shield and each protrusion of the second legs being spaced a second distance below a lower side face of the shield, the second distance being larger than the first distance;

wherein the insulative housing comprises an upper body, a lower body, and a plurality of spacing slots defined through the upper and the lower body, the upper body and the lower body further respectively defining a first and a second socket;

wherein the first socket defines the plurality of terminal receiving channels therethrough and the second socket defines a plurality of terminal passageways therethrough;

wherein the shield comprises a first part generally enclosing the upper body, a second part generally enclosing the lower body, and a third part enclosing a rear portion of the insulative housing, the three parts being engageable with each other;

wherein the locking device is formed on two side faces of the second part of the shield;

wherein the two side faces of the second part of the shield each form a pair of first locking legs and a pair of second locking legs, the first locking legs being positioned behind the second locking legs on one side face and the first locking legs being positioned ahead of the second locking legs on the other side face.

* * * * *